US010974318B2

(12) United States Patent
Takemura et al.

(10) Patent No.: US 10,974,318 B2
(45) Date of Patent: Apr. 13, 2021

(54) CAST PRODUCT MECHANICAL CHARACTERISTIC PREDICTION METHOD, CAST PRODUCT MECHANICAL CHARACTERISTIC PREDICTION SYSTEM, AND COMPUTER READABLE RECORDING MEDIUM RECORDING CAST PRODUCT MECHANICAL CHARACTERISTIC PREDICTION PROGRAM

(71) Applicant: MAZDA MOTOR CORPORATION, Hiroshima (JP)

(72) Inventors: Koji Takemura, Hiroshima (JP); Ichiro Kouno, Hatsukaichi (JP); Shohei Fujii, Hiroshima (JP); Shohei Hanaoka, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 200 days.

(21) Appl. No.: 16/195,990

(22) Filed: Nov. 20, 2018

(65) Prior Publication Data

US 2019/0184456 A1 Jun. 20, 2019

(30) Foreign Application Priority Data

Dec. 14, 2017 (JP) ..... JP2017-239598

(51) Int. Cl.

| | |
|---|---|
| ***B22D 17/20*** | (2006.01) |
| ***B22D 17/22*** | (2006.01) |
| ***B22D 21/00*** | (2006.01) |
| ***B22D 21/04*** | (2006.01) |

(52) U.S. Cl.

CPC ..... *B22D 17/20* (2013.01); *B22D 17/22* (2013.01); *B22D 21/007* (2013.01); *B22D 21/04* (2013.01)

(58) Field of Classification Search

CPC ..... B22D 17/20; B22D 17/22; B22D 21/00; B22D 21/007; B22D 21/04

USPC ..... 164/4.1, 150.1, 154.1, 113, 312

See application file for complete search history.

(56) References Cited

U.S. PATENT DOCUMENTS

| | | | | |
|---|---|---|---|---|
| 2004/0024480 | A1 | 2/2004 | Iimi et al. | |
| 2006/0277004 | A1 * | 12/2006 | Wang et al. ..... | B22D 37/00 703/1 |
| 2007/0270989 | A1 | 11/2007 | Yamasaki et al. | |

FOREIGN PATENT DOCUMENTS

| | | | |
|---|---|---|---|
| JP | 2003-145262 | A | 5/2003 |
| JP | 2004-066282 | A | 3/2004 |
| JP | 2005-014378 | A | 1/2005 |
| JP | 2005-315703 | A | 11/2005 |
| JP | 2007-167893 | A | 7/2007 |
| JP | 2007-307602 | A | 11/2007 |

(Continued)

*Primary Examiner* — Kevin P Kerns

(74) *Attorney, Agent, or Firm* — Studebaker & Brackett PC

(57) ABSTRACT

A CAE analysis die model is produced such that a cavity of a die for obtaining a cast product is divided into multiple elements. Fluidity analysis and solidification analysis are performed under a predetermined casting condition by means of the die model to calculate, for each element, a factor regarding growth of a solidification structure, a factor regarding purity of molten metal, and a factor regarding a hole defect. Mechanical characteristics of each portion of the cast product are obtained by a regression expression obtained by multiple regression analysis using mechanical characteristics of the cast product as an objective variable and using each factor as an explanatory variable.

8 Claims, 5 Drawing Sheets

(56) References Cited

FOREIGN PATENT DOCUMENTS

| | | | |
|---|---|---|---|
| JP | 2010-029925 | A | 2/2010 |
| JP | 2013-158814 | A | 8/2013 |
| JP | 2015-174116 | A | 10/2015 |
| JP | 2019-000861 | A | 1/2019 |

* cited by examiner

CAST PRODUCT MECHANICAL CHARACTERISTIC PREDICTION METHOD, CAST PRODUCT MECHANICAL CHARACTERISTIC PREDICTION SYSTEM, AND COMPUTER READABLE RECORDING MEDIUM RECORDING CAST PRODUCT MECHANICAL CHARACTERISTIC PREDICTION PROGRAM

CROSS-REFERENCE TO RELATED APPLICATIONS

This claims priority to Japanese Patent Application No. 2017-239598 filed to JPO on Dec. 14, 2017 under 35 U.S.C. 119, the entire contents of which are incorporated herein by reference.

BACKGROUND

The present invention relates to a cast product mechanical characteristic prediction method, a cast product mechanical characteristic prediction system, and a computer readable recording medium recording a program for predicting a cast product mechanical characteristic.

Japanese Unexamined Patent Application Publication No. 2005-315703 describes a method in which a steel component and an actual value or estimated value for manufacturing conditions are used as input to predict the quality of steel material manufactured by rolling and cooling of a casted steel piece after the steel piece has been re-heated. In this method, a metallurgical mathematical model is used to sequentially obtain, from the steel component and the actual value or estimated value for the manufacturing conditions, a metal structure change, an element solid-solution/deposition state, and a metal structure state upon re-heating, during cooling until the start of rolling, at each path during rolling, and during cooling after rolling. Then, the final post-cooling metal structure state and the final element solid-solution/deposition state and the quality of material calculated from the post-cooling metal structure state and the element solid-solution/deposition state are used as input items of a neural network model, thereby predicting the quality of steel material by the model.

SUMMARY

It has been known that mechanical characteristics (e.g., 0.2% proof stress, tensile strength, and elongation) of a cast product are not always uniform across the entirety of the cast product, and are partially different. One reason is that growth of a solidification structure influencing the mechanical characteristics, specifically DAS (Dendrite Arm Spacing; a spacing between secondary branches of a dendrite), varies by location of the cast product.

For this reason, the inventor(s) of the present invention has attempted to obtain factors (a solidification time etc.) regarding DAS by fluidity/solidification analysis of molten metal to predict mechanical characteristics of each portion of the cast product based on these factors. However, it has been found that in this method, although a result at a certain appropriateness level is obtained in prediction of the mechanical characteristics of each portion of the cast product by a gravity die casting method, deviation from an actual measurement value is great in prediction of mechanical characteristics of die-cast product. It is assumed that a reason is that in the case of die casting, a portion where a blow hole or a shrinkage hole is easily caused and a portion where a blow hole or a shrinkage hole is less caused are present in a die due to a high molten metal flow rate and rapid solidification of the molten metal.

For this reason, the present invention is intended to accurately predict mechanical characteristics of each portion of a cast product obtained by pressure casting.

For accomplishing the above-described objective, the present invention is configured to predict mechanical characteristics of each portion of a cast product considering not only a factor regarding growth of a solidification structure but also a factor regarding purity of molten metal and a factor regarding a hole defect.

A cast product mechanical characteristic prediction method disclosed herein is the method for predicting mechanical characteristics of each portion of a cast product obtained by pressure casting for pressure-injecting molten metal into a die, the method including producing a CAE (computer aided engineering) analysis die model such that a cavity of the die for obtaining the cast product is divided into multiple elements, performing fluidity analysis and solidification analysis under predetermined casting conditions by means of the die model to calculate, for each element, a factor regarding growth of a solidification structure, a factor regarding purity of the molten metal, and a factor regarding a hole defect, and applying each factor of each element to a regression expression obtained by multiple regression analysis using mechanical characteristics of the cast product as an objective variable and using each factor as an explanatory variable, thereby obtaining the mechanical characteristics of each portion.

Moreover, a cast product mechanical characteristic prediction system disclosed herein is a system for predicting mechanical characteristics of each portion of a cast product obtained by pressure casting for pressure-injecting molten metal into a die. The system includes a memory configured to store a regression expression obtained by multiple regression analysis using the mechanical characteristics as an objective variable and using, as an explanatory variable, a factor regarding growth of a solidification structure, a factor regarding purity of the molten metal, and a factor regarding a hole defect, the factors being obtained for each element by fluidity analysis and solidification analysis for the molten metal; and a central processing unit (CPU) connected to the memory, configured to produce a CAE analysis die model based on design data of the die for obtaining the cast product such that a cavity of the die is divided into multiple elements, configured to perform fluidity analysis and solidification analysis under predetermined casting conditions by means of the die model to calculate each factor for each element of the die model, and configured to apply each factor of each element obtained by fluidity analysis and solidification analysis to the regression expression, thereby calculating the mechanical characteristics of each portion.

Further, a cast product mechanical characteristic prediction program disclosed herein is a program for predicting mechanical characteristics of each portion of a cast product obtained by pressure casting for pressure-injecting molten metal into a die. The program causes a computer to implement the function of producing a CAE analysis die model based on design data of the die for obtaining the cast product such that a cavity of the die is divided into multiple elements, the function of performing fluidity analysis and solidification analysis under predetermined casting conditions by means of the die model to calculate, for each element, a factor regarding growth of a solidification structure, a factor regarding purity of the molten metal, and a factor regarding a hole defect, and the function of applying each factor of each element to a regression expression obtained by multiple regression analysis using mechanical characteristics of the cast product as an objective variable and using each factor as an explanatory variable, thereby calculating the mechanical characteristics of each portion.

A computer-readable recording medium for storing a cast product mechanical characteristic prediction program as disclosed herein is a computer-readable recording medium for recording a program for predicting mechanical characteristics of each portion of a cast product obtained by pressure casting for pressure-injecting molten metal into a die. The recording medium stores the cast product mechanical characteristic prediction program for causing a computer to implement the function of producing a CAE analysis die model based on design data of the die for obtaining the cast product such that a cavity of the die is divided into multiple elements, the function of performing fluidity analysis and solidification analysis under predetermined casting conditions by means of the die model to calculate, for each element, a factor regarding growth of a solidification structure, a factor regarding purity of the molten metal, and a factor regarding a hole defect, and the function of applying each factor of each element to a regression expression obtained by multiple regression analysis using mechanical characteristics of the cast product as an objective variable and using each factor as an explanatory variable, thereby calculating the mechanical characteristics of each portion.

The factor regarding growth of the solidification structure as described herein includes, for example, a "molten metal temperature upon completion of charging," a "solidification time," and a "cooling speed" as follows. From these factors, the type of cast structure (e.g., the type of DAS) is determined, and a state of the cast structure influences the mechanical characteristics.

The "molten metal temperature upon completion of charging" is a molten metal temperature at the element upon completion of charging of the cavity with the molten metal.

The "solidification time" is a time until the molten metal of the element reaches a solidus temperature after completion of charging (the start of solidification).

The "cooling speed" is a temperature decrement per unit time (° C./s) when the element reaches a defined temperature by cooling.

The factor regarding the purity of the molten metal includes, for example, an "air contact time" and a "flow distance" as follows. An oxide film is formed on a surface of the molten metal due to contact with air upon molten metal flow, and is taken into the molten metal to cause an inclusion defect. A longer contact time between the molten metal and air results in a greater amount of the oxide film taken into the molten metal, and therefore, leads to lower purity. Moreover, a longer flow distance of the molten metal results in a greater amount of mixing of a foreign substance (leading to the inclusion defect), which adheres to the die, with the molten metal, and therefore, leads to lower purity. That is, from the factor regarding the purity of the molten metal, the amount of inclusion defect is obtained, and the inclusion defect influences the mechanical characteristics.

The "air contact time" is a time of contact of the molten metal with air until the molten metal reaches the element.

The "flow distance" is a flow distance of the molten metal until the molten metal reaches the element.

The factor regarding the hole defect includes, for example, a "casting pressure," a gas entrainment amount," a "temperature gradient," and the "solidification time" as follows. From these factors, the presence/absence and degree of the hole defect (the blow hole, the shrinkage hole) are obtained, and influence the mechanical characteristics.

The "casting pressure" is a casting pressure applied to the molten metal of the element.

The "gas entrainment amount" is a gas entrainment amount of the element upon completion of flow of the molten metal.

The "temperature gradient" is a value (° C./mm) obtained in such a manner that a temperature difference between the element at a terminal stage of solidification and an adjacent element with the maximum temperature difference is divided by a distance between the elements.

According to the prediction method, the prediction system, the prediction program, and the recording medium for storing the prediction program, the mechanical characteristics of the cast product and a factor (a state quantity) exhibiting strong association with the mechanical characteristics obtained by fluidity analysis and solidification analysis are associated with each other by the regression expression by multiple regression analysis. Thus, when each factor of each element is acquired by fluidity analysis and solidification analysis by means of the die model, each factor is assigned to the regression expression so that the mechanical characteristics of each portion can be obtained.

The factor regarding growth of the solidification structure, the factor regarding the purity of the molten metal, and the factor regarding the hole defect are employed as the factors, and therefore, the mechanical characteristics of each portion of the cast product can be accurately predicted. That is, not only the state of the cast structure of the cast product but also the inclusion defect and the hole defect in association with the purity of the molten metal are taken into consideration for prediction of the mechanical characteristics, and therefore, reliability of such a predicted value is high.

Regarding the regression expression, the number of factors regarding growth of the solidification structure, the number of factors regarding the purity of the molten metal, and the number of factors regarding the hole defect as the explanatory variable may be one or more.

In the prediction method, the prediction system, the prediction program, and the recording medium for storing the prediction program, the solidification time is, in one embodiment, used as the factor regarding growth of the solidification structure, the air contact time and the flow distance are used as the factor regarding the purity of the molten metal, and the solidification time, the casting pressure, and the temperature gradient are used as the factor regarding the hole defect.

With this configuration, the mechanical characteristics of each portion of the cast product can be accurately predicted.

In the prediction method, the objective variable of the regression expression is mechanical characteristics of an as-cast state of the cast product, mechanical characteristics of an as-cast state of each portion are obtained as the mechanical characteristics of each portion by means of the regression expression, and the mechanical characteristics of the as-cast state of each portion are applied to correlation data showing a correlation between the mechanical characteristics of the as-cast state of the cast product and mechanical characteristics after heat treatment has been performed for the cast product, thereby obtaining the mechanical characteristics of each portion after the heat treatment.

In the prediction system, the objective variable of the regression expression is, in one embodiment, mechanical characteristics of an as-cast state of the cast product, the memory stores the regression expression and correlation data showing a correlation between the mechanical characteristics of the as-cast state of the cast product and mechanical characteristics after heat treatment has been performed for the cast product, and the central processing unit obtains mechanical characteristics of an as-cast state of each portion by means of the regression expression, and applies the mechanical characteristics of the as-cast state of each portion to the correlation data, thereby obtaining the mechanical characteristics of each portion after the heat treatment.

In the prediction program, the objective variable of the regression expression is, in one embodiment, mechanical characteristics of an as-cast state of the cast product, and the function of obtaining the mechanical characteristics of each portion includes the function of obtaining mechanical characteristics of an as-cast state of each portion by means of the regression expression, and the function of applying the mechanical characteristics of the as-cast state of each portion to correlation data showing a correlation between the mechanical characteristics of the as-cast state of the cast product and mechanical characteristics after heat treatment has been performed for the cast product, thereby obtaining the mechanical characteristics of each portion after the heat treatment.

In the computer-readable recording medium for recording the prediction program, the objective variable of the regression expression is, in one embodiment, mechanical characteristics of an as-cast state of the cast product, and the function of obtaining the mechanical characteristics of each portion includes the function of obtaining mechanical characteristics of an as-cast state of each portion by means of the regression expression, and the function of applying the mechanical characteristics of the as-cast state of each portion to correlation data showing a correlation between the mechanical characteristics of the as-cast state of the cast product and mechanical characteristics after heat treatment has been performed for the cast product, thereby obtaining the mechanical characteristics of each portion after the heat treatment.

According to each embodiment of the prediction method, the prediction system, the prediction program, and the recording medium for storing the prediction program, the mechanical characteristics of the as-cast state of each portion of the cast product are obtained by the regression expression, and therefore, the mechanical characteristics of each portion after the heat treatment can be obtained by the correlation data. That is, in the case of predicting the mechanical characteristics after various types of heat treatment, the correlation data is prepared for each type of heat treatment so that the mechanical characteristics after each type of heat treatment can be easily predicted by the correlation data without preparing the regression expression for each type of heat treatment for performing fluidity/solidification analysis.

The data format of the correlation data may be a function format or a table format.

In the prediction method, the prediction system, the prediction program, and the recording medium for storing the prediction program, pressure casting is die casting of aluminum alloy in one embodiment. Die casting of other types of metal such as magnesium alloy may be employed.

Moreover, the present invention can be utilized for casting of various machine components such as an engine cylinder head, an engine cylinder block, a transmission case, and a suspension arm.

DETAILED DESCRIPTION

Hereinafter, a mode for carrying out the present invention will be described with reference to the drawings. The following description of a preferred embodiment will be set forth merely as an example in nature, and is not intended to limit the present invention, applications thereof, and use thereof.

<Mechanical Characteristic Prediction System of Cast Product>

Figure 1:
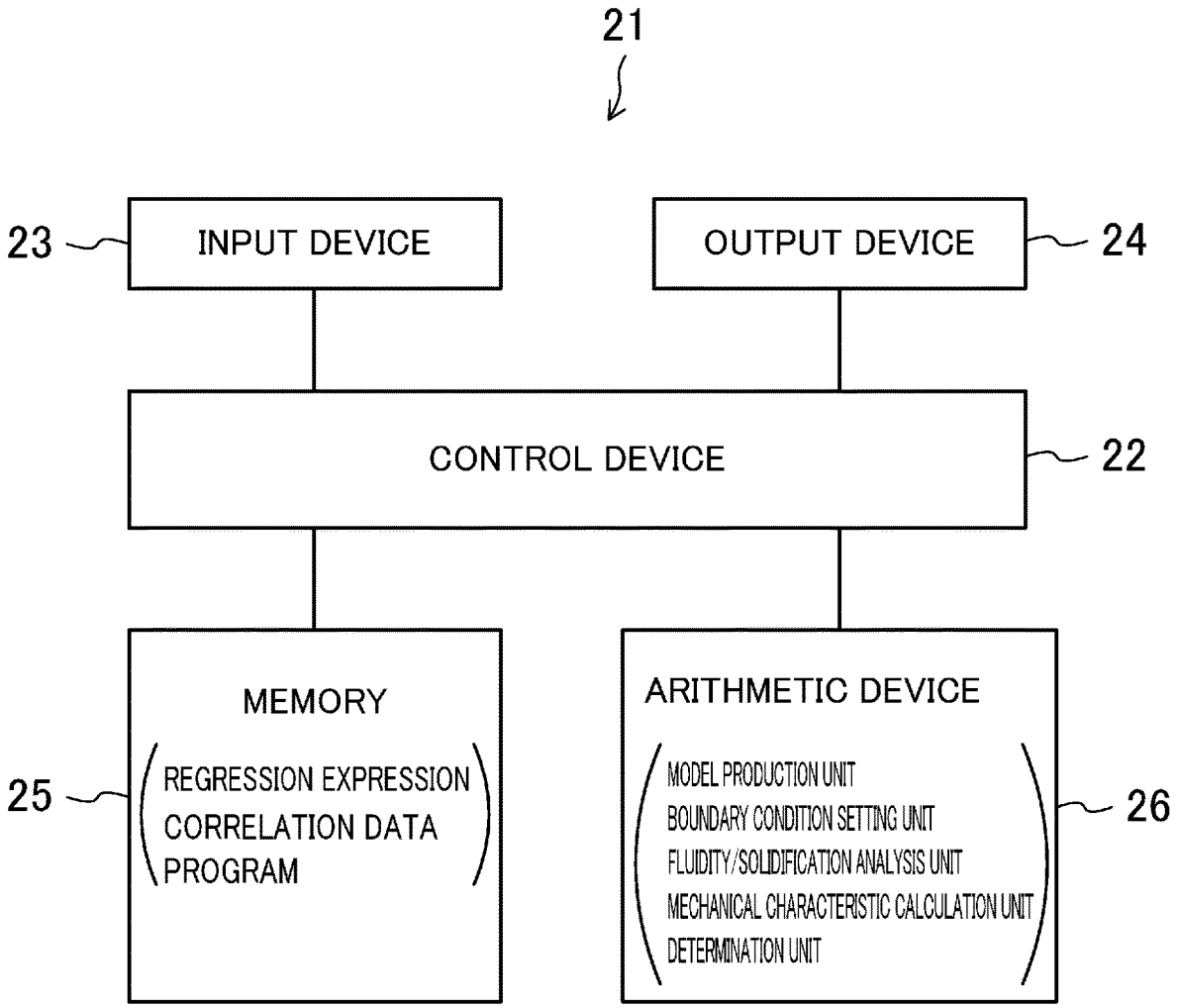
FIG. 1 is a block diagram of a mechanical characteristic prediction system of a cast product.

As illustrated in FIG. 1, a mechanical characteristic prediction system 21 of a cast product according to the present embodiment is a computer aided engineering (CAE) system for casting, and includes a control device 22, an input device 23, an output device 24, a memory 25, and an arithmetic device 26. The cast product is obtained by pressure casting for pressure-injecting molten metal into a die, and in the present embodiment, is obtained by high-pressure die casting.

The input device 23, the output device 24, the memory 25, and the arithmetic device 26 are connected to the control device 22. The input device 23 includes a keyboard and a mouse connected to a computer, and is configured to input a numerical value, an instruction, etc. to the arithmetic device 26. The output device 24 includes a display etc. connected to the computer, and is configured to display various types of data based on an arithmetic result etc. obtained by the arithmetic device 26. A storage unit including a RAM, a ROM, etc. in the computer is used as the memory 25, and a central processing unit (CPU) of the computer is used as the arithmetic device 26.

The memory 25 is configured to store, for example, information regarding a casting plan including the die, information regarding casting conditions, information regarding arithmetic operation in the arithmetic device 26, and a program for executing arithmetic processing for mechanical characteristic prediction. Moreover, the memory 25 is configured to store a regression expression and correlation data for predicting mechanical characteristics of each portion of the cast product.

The arithmetic device 26 is configured to perform arithmetic operation according to the stored arithmetic program based on the data stored in the memory 25 and the numerical value and the instruction input from the input device 23. The arithmetic device 26 includes, as described later, a model production unit, a boundary condition setting unit, a fluidity/solidification analysis unit, a mechanical characteristic calculation unit, and a determination unit.

<Regression Expression>

The regression expression for predicting the mechanical characteristics of each portion of the cast product is a regression expression obtained by multiple regression analysis, the regression expression using mechanical characteristics of an as-cast state (an F-material) of the cast product as an objective variable and using, as an explanatory variable, multiple factors obtained by fluidity analysis and solidification analysis (simulation analysis) for the molten metal by means of a three-dimensional die model (mesh model) for CAE analysis and exhibiting strong correlation with the mechanical characteristics.

The die model (the 3D (three-dimensional) mesh model) for CAE analysis is produced using a casting plan 3DCAD (three-dimensional computer-aided design) model (die design data) produced at the stage of designing of the die for the cast product. Such production can be performed by the model production unit of the arithmetic device 26. Specifically, the casting plan 3DCAD model is mesh-divided to produce such a die model that a cavity of the die is divided into multiple elements. Note that a mesh size and an element shape are optional.

Fluidity analysis and solidification analysis can be performed by the fluidity/solidification analysis unit of the arithmetic device 26. Specifically, boundary conditions corresponding to casting conditions to be employed in pressure casting for the cast product are set for performing fluidity analysis and solidification analysis. These boundary conditions can be set by the boundary condition setting unit of the arithmetic device 26. A molten metal temperature, an injection speed, a die temperature, and a gate shape and a gate position are set as the boundary conditions, for example. These boundary conditions are automatically selected and set by the boundary condition setting unit based on the casting conditions stored in the memory 25. Note that an operator may input the boundary conditions via the input device 23.

By such fluidity analysis and such solidification analysis, the multiple factors (state quantities) exhibiting strong correlation with the mechanical characteristics of each element of the cavity, such as a solidification time, are obtained.

Meanwhile, the cast product is obtained by pressure casting using the die, and test pieces are cut out from various portions of the cast product, specifically portions different from each other in the solidification time etc. For each test piece, e.g., a tensile test is performed to actually measure the mechanical characteristics. For improvement of reliability, the number of test pieces is preferably great.

Based on the multiple factors obtained by fluidity analysis and solidification analysis and actual measurement values of the mechanical characteristics, the regression expression using the mechanical characteristics as the objective variable and using the multiple factors as the explanatory variable is calculated by multiple regression analysis. For such calculation, spreadsheet software (Excel by Microsoft Corporation) can be used.

In this embodiment, a factor regarding growth of a solidification structure, a factor regarding purity of the molten metal, and a factor regarding a hole defect are employed as the factors exhibiting strong correlation with the mechanical characteristics.

Specifically, at least one of a "molten metal temperature upon completion of charging," the "solidification time," or a "cooling speed" is employed as the factor (a factor regarding DAS) regarding growth of the solidification structure. At least one of an "air contact time" or a "flow distance" is employed as the factor regarding the purity of the molten metal. At least one of a "casting pressure," a "gas entrainment amount," a "temperature gradient," or the "solidification time" is employed as the factor regarding the hole defect.

For example, when the mechanical characteristics are 0.2% proof stress, the regression expression is represented as follows:

$$0.2\%\ \text{Proof Stress}=(C1\times\text{Molten Metal Temperature upon Completion of Charging}+C2\times\text{Solidification Time}+C3\times\text{Cooling Speed})+(C4\times\text{Air Contact Time}+C5\times\text{Flow Distance})+(C6\times\text{Casting Pressure}+C7\times\text{Gas Entrainment Amount}+C8\times\text{Temperature Gradient}+C9\times\text{Solidification Time})+K \quad (1)$$

In the regression expression above, C1 to C9 are coefficients, and K is a constant term.

For the sake of convenience, the "solidification time" is divided into a term regarding growth of the solidification structure and a term regarding the hole defect, but can be collectively represented as "(C2+C9)×Solidification Time."

A shorter solidification time results in more blow holes caused due to rapid cooling of gas entrained in the molten metal. On the other hand, as the solidification time increases, the temporarily-entrained gas is released, or more blow holes are crushed by pressure casting. Thus, shrinkage holes due to solidification shrinkage are dominant as the hole defect. A mechanism for generating the hole defect is different depending on the length of the solidification time as described above, and therefore, "C9×Solidification Time" of the regression expression may be separately set when the solidification time is equal to or shorter than a predetermined value and when the solidification time exceeds the predetermined value, for example. That is, multiple different regression expressions may be set and used differently according to the length of the solidification time.

<Correlation Data>

Figure 2:
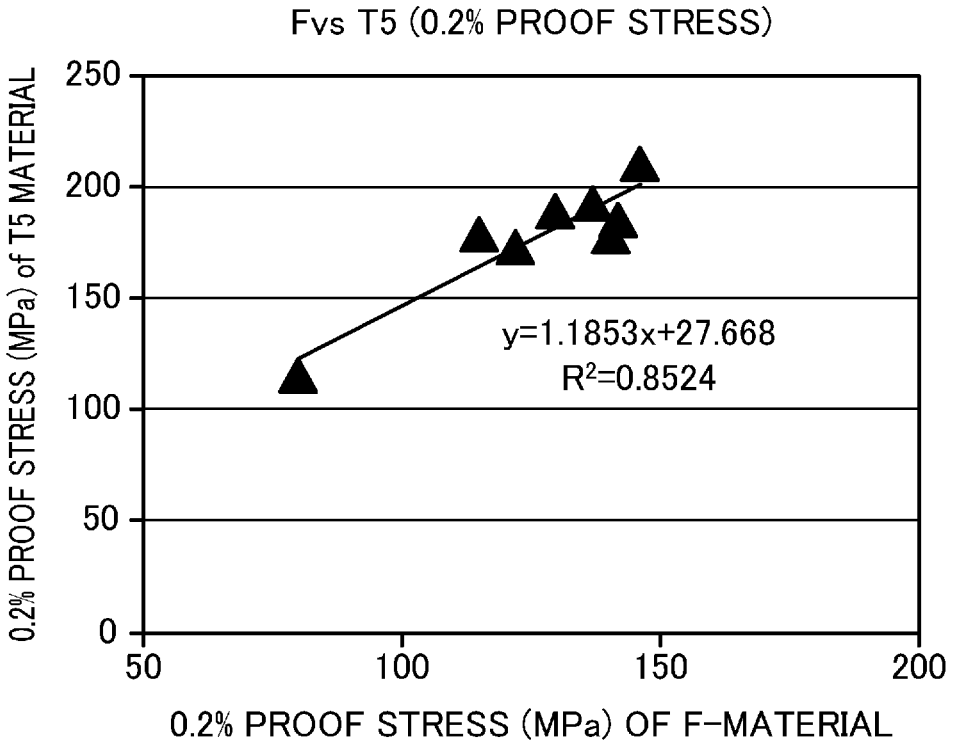
FIG. 2 is a correlation chart of 0.2% proof stress of an F-material and a T5 treatment material.
Figure 3:
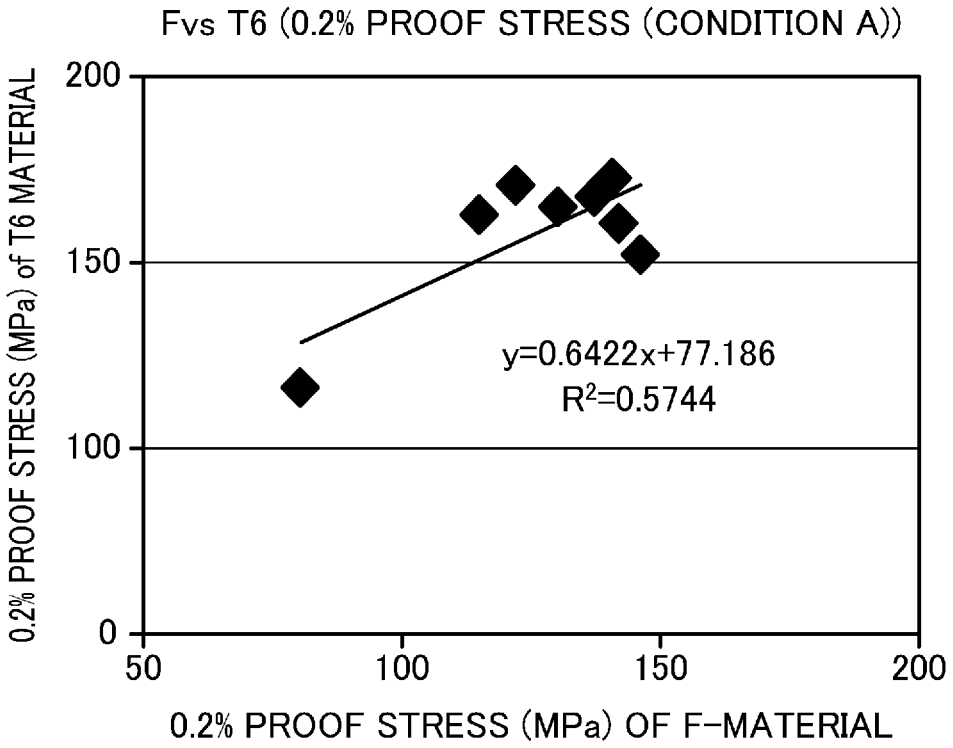
FIG. 3 is a correlation chart of 0.2% proof stress of the F-material and a T6 treatment material (a condition A).
Figure 4:
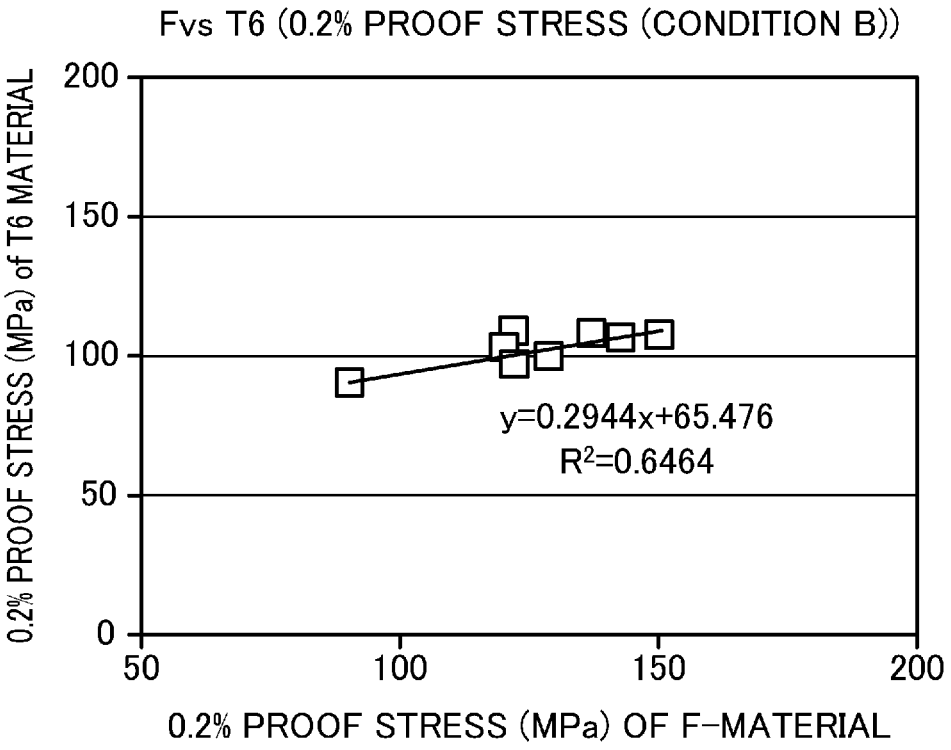
FIG. 4 is a correlation chart of 0.2% proof stress of the F-material and a T6 treatment material (a condition B).

The mechanical characteristics of the as-cast state, i.e., the F-material, of the cast product (aluminum alloy) and mechanical characteristics after heat treatment has been performed for the F-material show relatively-strong correlation as illustrated in FIGS. 2 to 4. FIG. 2 is a correlation chart between 0.2% proof stress of a T5 material subjected to T5 treatment as the heat treatment and 0.2% proof stress of the F-material. FIG. 3 is a correlation chart between 0.2% proof stress of a T6 material (A) subjected to T6 treatment as the heat treatment under a predetermined condition A and the 0.2% proof stress of the F-material. FIG. 4 is a correlation chart of 0.2% proof stress of a T6 material (B) subjected to the T6 treatment as the heat treatment under a condition B different from the condition A and the 0.2% proof stress of the F-material. Functions (correlation data) shown in FIGS. 2 to 4 are obtained by a least-square method.

<Mechanical Characteristic Prediction Method for Cast Product>

A mechanical characteristic prediction method for the cast product according to the present embodiment will be described with reference to a flowchart shown in FIG. 5.

[Production of CAE Analysis Die Model]

Figure 5:
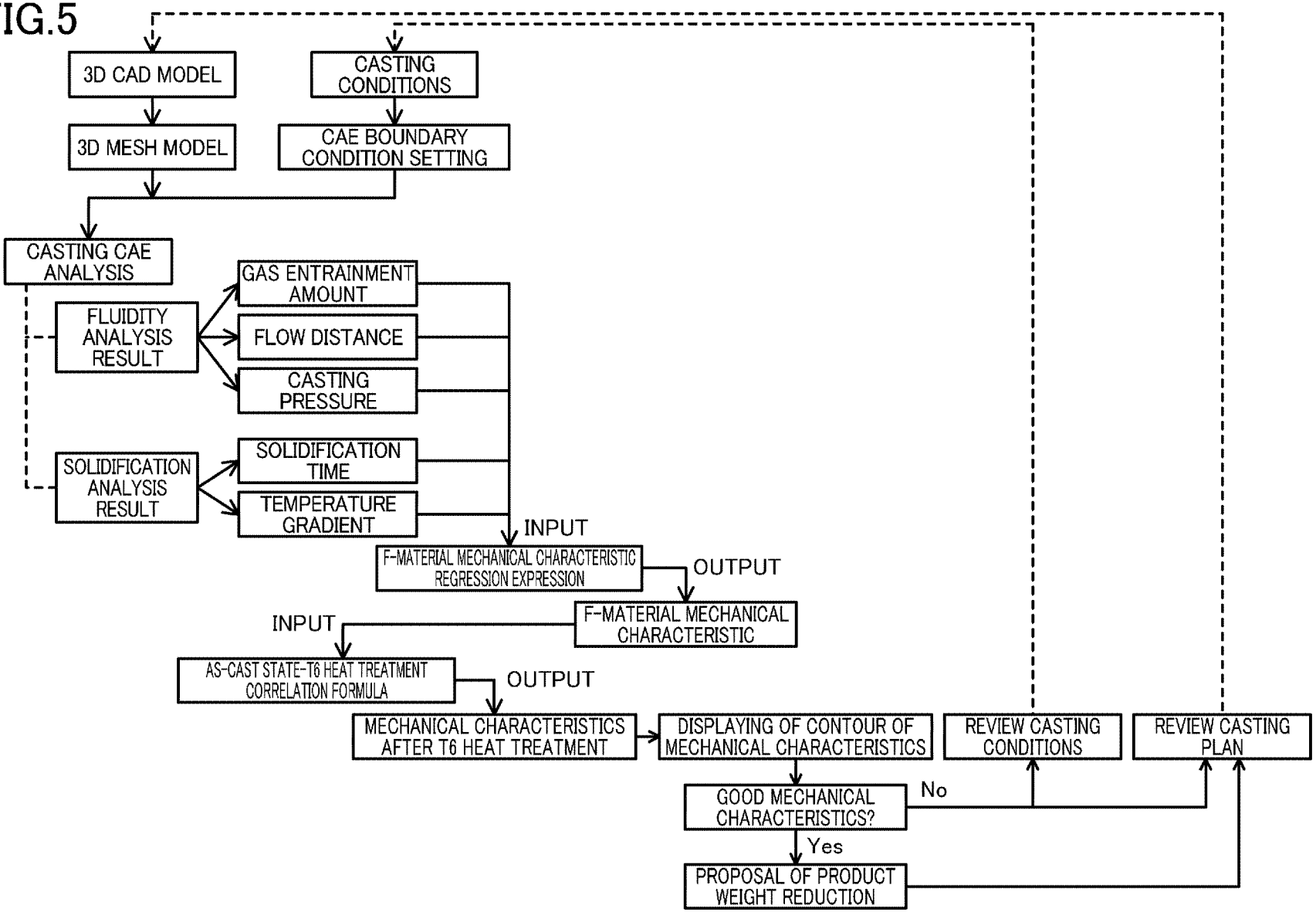
FIG. 5 is a processing flowchart of mechanical characteristic prediction according to an embodiment of the present invention.

By the model production unit of the arithmetic device 26, the casting plan 3DCAD model of the cast product for which the mechanical characteristics are to be predicted as shown in FIG. 5 is mesh-divided. In this manner, the die model (the 3D mesh model) for CAE analysis, i.e., the die model in which the cavity of the die is divided into the multiple elements, is produced. Note that the mesh size and the element shape are optional.

[Fluidity Analysis and Solidification Analysis]

By the fluidity/solidification analysis unit of the arithmetic device 26, fluidity analysis and solidification analysis for the molten metal are performed using the die model. The boundary conditions (molten metal injection conditions etc.)

for fluidity analysis and solidification analysis are set by the boundary condition setting unit of the arithmetic device 26 based on the casting conditions for the cast product.

By fluidity analysis and solidification analysis, the factor regarding growth of the solidification structure, the factor regarding the purity of the molten metal, and the factor regarding the hole defect are calculated for each element. FIG. 5 shows a case where a fluidity analysis result and each factor of the air contact time, the flow distance, and the casting pressure are output and a solidification analysis result and each factor of the solidification time and the temperature gradient are output.

[Calculation of Mechanical Characteristics of F-Material]

By the mechanical characteristic calculation unit of the arithmetic device 26, each factor of each element obtained by fluidity analysis and solidification analysis is applied to the regression expression stored in the memory 25, and the mechanical characteristics of each portion of the F-material (the as-cast state of the cast product) are obtained. In the case where five factors are used as shown in FIG. 5, the regression expression stored in advance according to the mechanical characteristics of the F-material is as follows in the case of the 0.2% proof stress:

$$0.2\%\ \text{Proof Stress}=\alpha\times\text{Solidification Time}+\beta\times\text{Air Contact Time}+\gamma\times\text{Flow Distance}+\delta\times\text{Casting Pressure}+\xi\times\text{Temperature Gradient}+\eta \quad (2),$$

where $\alpha$, $\beta$, $\gamma$, $\delta$, and $\xi$ are coefficients and $\eta$ is a constant term.

[Calculation of Mechanical Characteristics after Heat Treatment]

By the mechanical characteristic calculation unit of the arithmetic device 26, the mechanical characteristics of each portion of the cast product after the heat treatment are calculated from the mechanical characteristics of the F-material and the correlation data stored in the memory 25. In an example shown in FIG. 5, correlation data regarding the T6 treatment is used to calculate the mechanical characteristics after the T6 treatment. A calculation result of the mechanical characteristics after the T6 treatment is, by the output device 24, displayed on a display as a contour figure in which the mechanical characteristics are color-coded and displayed according to intensity on a figure of a cast product model.

[Mechanical Characteristic Appropriateness Determination]

Based on the calculation result of the mechanical characteristics after the T6 treatment, appropriateness of the casting plan and/or the casting conditions is determined. Such determination is performed in the determination unit of the arithmetic device 26. Specifically, the determination unit includes a predetermined threshold for the mechanical characteristics, and determines the appropriateness of mechanical characteristics of a determination target element by comparison between the mechanical characteristics of the element and the threshold. Such a determination result is, by the output device 24, color-coded and displayed on the figure of the cast product model, and a warning is issued when there is an element with a mechanical characteristic failure.

Moreover, when there is the element with the mechanical characteristic failure, a change is made to the casting plan or the casting conditions, and steps from [Production of CAE Analysis Die Model] to [Mechanical Characteristic Appropriateness Determination] are repeated or steps from [Fluidity Analysis and Solidification Analysis] to [Mechanical Characteristic Appropriateness Determination] are repeated. In this manner, the mechanical characteristics can be determined as good.

Even when the mechanical characteristics are determined as good, a change is made to the casting plan for, e.g., product weight reduction, and the steps from [Fluidity Analysis and Solidification Analysis] to [Mechanical Characteristic Appropriateness Determination] are repeated. In this manner, the appropriateness of the mechanical characteristics can be determined.

[Prediction of 0.2% Proof Stress]

A suspension lower arm of an automobile was casted as the cast product by die casting of aluminum alloy. While 0.2% proof stress of each portion of the lower arm is actually measured by the tensile test, the 0.2% proof stress of each portion was predicted by the regression expression of Expression (2) above.

Figure 6:
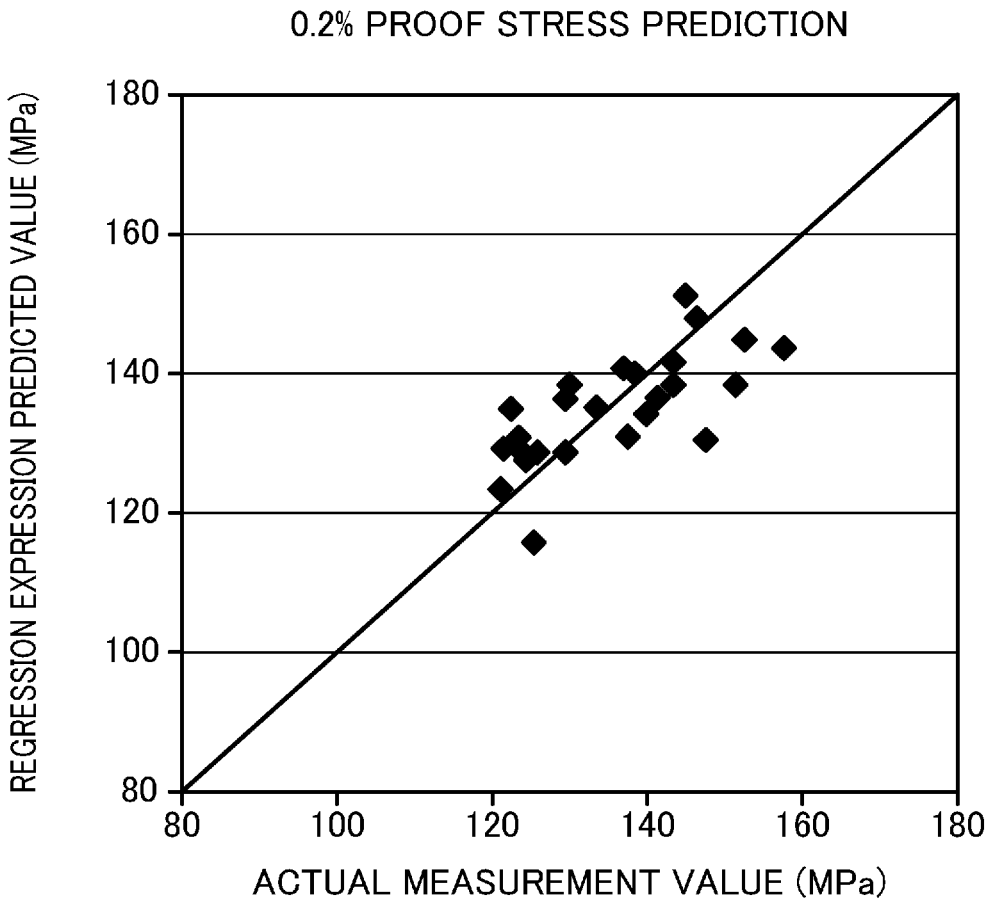
FIG. 6 is a graph of a correspondence relationship between an actual measurement value and a predicted value of mechanical characteristics.

A result is shown in FIG. 6. According to this figure, it has been found that the actual measurement value and a predicted value are in an incredibly good correspondence relationship with each other and prediction of the mechanical characteristics according to the present invention is useful and exhibits high reliability.

[Recording Medium]

For example, a flexible disk, a hard drive, an optical disk, a magnet-optical disk, a CD-ROM, a DVD-ROM, a magnetic tape, and a non-volatile memory card can be used as a recording medium configured to store programs for causing the computer to implement the function of producing the die model for CAE analysis, the function of calculating various factors regarding the mechanical characteristics by fluidity analysis and solidification analysis, and the function of obtaining the mechanical characteristics of each portion of the cast product from the regression expression and the correlation data.

OTHER

The cast product mechanical characteristics to be predicted are not limited to the 0.2% proof stress, and may be tensile strength, elongation, etc.

The objective variable of the regression expression is not necessarily the mechanical characteristics of the as-cast state, but may be the mechanical characteristics after the heat treatment such as the T6 treatment.

What is claimed is:

1. A method for predicting 0.2% proof stress, tensile strength, or elongation as a mechanical characteristic of each portion of a cast product obtained by pressure casting for pressure-injecting molten metal into a die, comprising:

producing a CAE analysis die model such that a cavity of the die for obtaining the cast product is divided into multiple elements;

performing fluidity analysis and solidification analysis under a predetermined casting condition by means of the die model to calculate, for each element, a factor regarding growth of a solidification structure, a factor regarding purity of the molten metal, and a factor regarding a hole defect; and applying each factor of each element to a regression expression obtained by multiple regression analysis using a mechanical characteristic of the cast product as an objective variable and using each factor as an explanatory variable, thereby obtaining the mechanical characteristic of each portion.

2. The cast product mechanical characteristic prediction method according to claim 1, wherein a solidification time of the molten metal at each element is used as the factor regarding growth of the solidification structure, an air contact time and a flow distance of the molten metal until the molten metal reaches each element are used as the factor regarding the purity of the molten metal, and the solidification time of the molten metal at each element, a casting pressure applied to the molten metal of each element, and a temperature gradient between each element at a terminal stage of solidification and an adjacent element with a maximum temperature difference are used as the factor regarding the hole defect.

3. The cast product mechanical characteristic prediction method according to claim 1, wherein the objective variable of the regression expression is a mechanical characteristic of an as-cast state of the cast product, a mechanical characteristic of an as-cast state of each portion is obtained as the mechanical characteristic of each portion by means of the regression expression, and the mechanical characteristic of the as-cast state of each portion is applied to correlation data showing a correlation between the mechanical characteristic of the as-cast state of the cast product and a mechanical characteristic after heat treatment has been performed for the cast product, thereby obtaining the mechanical characteristic of each portion after the heat treatment.

4. The cast product mechanical characteristic prediction method according to claim 1, wherein the pressure casting is die casting of aluminum alloy.

5. A system configured for predicting 0.2% proof stress, tensile strength, or elongation as a mechanical characteristic of each portion of a cast product obtained by pressure casting for pressure-injecting molten metal into a die, comprising:

a memory configured to store a regression expression obtained by multiple regression analysis using the mechanical characteristic as an objective variable and using, as an explanatory variable, a factor regarding growth of a solidification structure, a factor regarding purity of the molten metal, and a factor regarding a hole defect, the factors being obtained for each element by fluidity analysis and solidification analysis for the molten metal; and a central processing unit as a CPU connected to the memory, configured to produce a CAE analysis die model based on design data of the die for obtaining the cast product such that a cavity of the die is divided into multiple elements, configured to perform the fluidity analysis and the solidification analysis under a predetermined casting condition by means of the die model to calculate each factor for each element of the die model, and configured to apply each factor of each element obtained by the fluidity analysis and the solidification analysis to the regression expression, thereby calculating the mechanical characteristic of each portion.

6. The cast product mechanical characteristic prediction system according to claim 5, wherein a solidification time of the molten metal at each element is used as the factor regarding growth of the solidification structure, an air contact time and a flow distance of the molten metal until the molten metal reaches each element are used as the factor regarding the purity of the molten metal, and the solidification time of the molten metal at each element, a casting pressure applied to the molten metal of each element, and a temperature gradient between each element at a terminal stage of solidification and an adjacent element with a maximum temperature difference are used as the factor regarding the hole defect.

7. The cast product mechanical characteristic prediction system according to claim 5, wherein the objective variable of the regression expression is a mechanical characteristic of an as-cast state of the cast product, the memory stores the regression expression and correlation data showing a correlation between the mechanical characteristic of the as-cast state of the cast product and a mechanical characteristic after heat treatment has been performed for the cast product, and the central processing unit obtains a mechanical characteristic of an as-cast state of each portion by means of the regression expression, and applies the mechanical characteristic of the as-cast state of each portion to the correlation data, thereby obtaining the mechanical characteristic of each portion after the heat treatment.

8. The cast product mechanical characteristic prediction system according to claim 5, wherein the pressure casting is die casting of aluminum alloy.

* * * * *